US009392671B2

(12) United States Patent
Huang

(10) Patent No.: US 9,392,671 B2
(45) Date of Patent: Jul. 12, 2016

(54) LAMP CONTROLLER WITH EXTENDED LIFE

(71) Applicant: Xiamen Xing HengLong Lighting Technology Co., Ltd., Xiamen, Fujian (CN)

(72) Inventor: Huaqing Huang, Xiamen (CN)

(73) Assignee: XIAMEN XING HENGLONG LIGHTING TECHNOLOGY CO., LTD., Xiamen (CN)

( * ) Notice: Subject to any disclaimer, the term of this patent is extended or adjusted under 35 U.S.C. 154(b) by 680 days.

(21) Appl. No.: 13/678,199

(22) Filed: Nov. 15, 2012

(65) Prior Publication Data

US 2013/0162148 A1 Jun. 27, 2013

(30) Foreign Application Priority Data

Dec. 23, 2011 (CN) ..... 2011 1 0439668

(51) Int. Cl.
*H05B 39/04* (2006.01)
*H05B 37/02* (2006.01)
*H05B 33/08* (2006.01)

(52) U.S. Cl.
CPC ..... *H05B 37/02* (2013.01); *H05B 33/0806* (2013.01)

(58) Field of Classification Search
CPC ..... H02M 3/33523; H02M 3/3376; H02M 7/217; H02M 2001/007; H02M 7/48; H02M 7/53875; H02M 2001/0006; H02M 2001/009; H02M 3/07; H05B 33/0818; H05B 33/0815; H05B 33/0851; H05B 33/08; H05B 33/0845
See application file for complete search history.

(56) References Cited

U.S. PATENT DOCUMENTS

2012/0250360 A1* 10/2012 Orr ..... H02M 3/3376 363/21.02
2013/0307514 A1* 11/2013 O'Connell et al. H03K 17/6874 323/312

* cited by examiner

*Primary Examiner* — Douglas W Owens
*Assistant Examiner* — Monica C King
(74) *Attorney, Agent, or Firm* — Rabin & Berdo, P.C.

(57) ABSTRACT

A lamp controller has an LED lamp. The lamp is disposed with a light source and two same drive circuits, one of the drive circuits is work drive circuit, the other one is the backup drive circuit, the two drive circuits output are parallel to each other and connected to the light source; the controller includes an AC/DC conversion circuit, microcontroller, switch circuit and drive state detection circuit, the AC/DC conversion circuit is converted the mains supply to low-voltage direction current and supplying power to the microcontroller and the switch circuit, the drive state detect circuit gets the work state information of the work state drive circuit and submits the information to the microcontroller, the microcontroller controls the switch circuit to alternatively connect the input of the work drive circuit or the backup drive circuit to the mains supply according to the work drive circuit work state information.

3 Claims, 6 Drawing Sheets

LAMP CONTROLLER WITH EXTENDED LIFE

FIELD OF THE INVENTION

The present invention relates to an LED lamp with extended life.

BACKGROUND OF THE INVENTION

Nowadays, as lighting fixtures, there are incandescent, fluorescent lamp, sodium lamp, high pressure sodium lamp, halogen lamp and LED and OLED recently high developing light source devices. The life of the light source of the traditional incandescent, fluorescent lamp, sodium lamp, halogen lamp are within 2000 hours, the life of the corresponding semiconductor power driver can meet the requirement of the life of the light source. But in high pressure sodium lamp and halogen lamp, the life reaches to 30000 to 50000 hours and the life of the corresponding driver is nearly to the life of the light source. In the recent developing LED, OLED lighting, the life of the light source can reach to 100000 hours. But there is not a high reliable lamp of 100000 hours. The LED lamp on the market can only provide 3 to 5 years of quality protection, because the life of the corresponding LED drive circuit can not meet the requirement. The existing fully developed and high quality of the LED drive power is provided with 3 years' quality assurance, fewer with 5 years' quality assurance. The life of the drive power is between 300000 to 500000 hours. The life of the drive power determines the life of the LED lamp. For a high reliable and long life LED lamp, the life of the LED light source is 100000 hours, but the life of the coupled drive power is only 500000 hours.

It greatly reduces the utilization of the LED and rarely meets the requirement of the high reliable lamp of 100000 hours. If these lamps are end-of-life treated in advance by the user or the manufacturer, it leads to a high wasting of the LED and lamp housing and other durable resource. If these lamps are repaired, it takes a lot of manpower and material cost. Especially for lamps installed high or in certain places, it takes high maintenance cost, even that the maintenance cost will be higher that the overall cost of the lamp. These maintenance cost makes the energy saving effect greatly reduced.

SUMMARY OF THE INVENTION

The object of the present invention is to provided with a lamp controller with extended life, in which the light source is powered automatically by the backup drive circuit when the work drive circuit is broken down to prevent lamp end in life in advance due to the shorter life of the drive circuit than that of the light source.

A lamp controller with extended life, the lamp is disposed with a light source and two same drive circuits, one of the drive circuits is work drive circuit, the other one is the backup drive circuit, the output of the two drive circuits are parallel to each other and connected to the light source; the controller includes an AC/DC conversion circuit, microcontroller, switch circuit and drive state detection circuit, the AC/DC conversion circuit is converted the mains supply to low-voltage direction current and supplying power to the microcontroller and the switch circuit, the drive state detect circuit gets the work state information of the work state drive circuit and submits the information to the microcontroller, the microcontroller controls the switch circuit to alternatively connect the input of the work drive circuit or the backup drive circuit to the mains supply according to the work state information of the work drive circuit.

In another preferred embodiment, the drive state detect circuit is disposed with an AC input, an AC output and a signal detect output, the switch circuit is disposed with an AC input, a first AC output, a second AC output and a signal control input; the AC input of the drive state detect circuit is connected to the mains supply, the AC output of the drive state detect circuit of the drive state detection circuit is connected to the AC input of the switch circuit; the signal detect output of the drive state detection circuit is connected to the signal detect input of the microcontroller; the first AC output of the switch circuit is connected to the input of the work drive circuit, and the second AC output of the switch circuit is connected to the input of the backup drive circuit.

In another preferred embodiment, the drive state detection circuit is disposed with two same lines, each line is disposed with an independent AC input, AC output and signal detect output, the switch circuit is disposed with an AC input, a first AC output, a second AC output and signal control input; the AC input of the switch circuit is connected to the mains supply, the first AC output of the switch circuit is connected to the AC input of the first line of the drive state detection circuit, the second AC output of the switch circuit is connected to the AC input of the second line of the drive state detection circuit; the signal control input of the switch circuit is connected to the signal control output of the microcontroller; the AC output of the first line of the drive state detection circuit is connected to the input of the work drive circuit, the AC output of the second line of the drive state detection circuit is connected to the input of the backup drive circuit; the signal detect outputs of the first line and second line of the drive state detection circuit are separately connected to the corresponding signal detect input of the two signal detect inputs of the microcontroller. With the two lines of the drive state detection circuit to detect current work state of the drive circuit in different situation, the two drive circuits can be changed, the application is more flexible.

In another preferred embodiment, the switch circuit is consisting of an electromagnet relay and a signal control amplifier; the earth line of the AC input of the switch circuit is connected to that of the first AC output and the second AC output; the AC/DC conversion circuit supplies power to the signal control amplifier; the input terminal of the alternative switch of the electromagnet relay is the live line of the AC input of the switch circuit, two output terminals of the alternative switch of the electromagnet relay are separately the live line of the first and the second AC output of the switch circuit; the signal control amplifier amplifies the control signal of the microcontroller and motivates the coil of the electromagnet relay, making the alternative switch of the electromagnet relay alternatively connected the input terminal to one of the two output terminals. The switch circuit is of high reliably and long life time through the electromagnet relay to separate the detects of the AC strong electric and DC weak electric.

In another preferred embodiment, the switch circuit is consisting of a solid relay and a signal control amplifier; the earth line of the AC input of the switch circuit is connected to that of the first AC output and the second AC output; the AC/DC conversion circuit supplies power to the signal control amplifier; the input terminal of the alternative switch of the solid relay is the live line of the AC input of the switch circuit, two output terminals of the alternative switch of the solid relay are separately the live line of the first and the second AC output of the switch circuit; the signal control amplifier amplifies the control signal of the microcontroller and motivates the coil of the solid relay, making the alternative switch of the solid relay alternatively connected the input terminal to one of the two output terminals. The switch circuit is of simple structure, easy assembly and low cost through the solid relay to separate the detects of the AC strong electric and DC weak electric.

In another preferred embodiment, the drive state detection circuit is consisting of a current transformer and a current/voltage conversion circuit; the two ends of the primary side of the current transformer are separately the AC input and AC output of the drive state detection circuit; the secondary side of the current transformer is connected to the input of the current/voltage conversion circuit; the output of the current/voltage conversion circuit is the signal detect output of the drive state detection circuit. The drive state detection circuit is of high reliably and long life time through the current transformer to separate the detects of the AC strong electric and DC weal electric. The current/ voltage conversion circuit gets the analog drive state signal. Change the condition parameter of the drive state of the drive circuit determined by the control procedure of the microcontroller, it can be applicable in different work current range of drive circuit with wide applicability and flexible usage.

In another preferred embodiment, the drive state detection circuit is consisting of a detect resistor, a optocoupler and a current/voltage conversion circuit; the two ends of the detect resistor are separately the AC input and AC output of the drive state detection circuit; the detect resistor is parallel connected to the light emitting diode of the optocoupler, the receiver of the optocoupler is connected to the input of the current/voltage conversion circuit; the output of the current/voltage conversion circuit is the signal detect output of the drive state detection circuit. The drive state detection circuit is of high reliably and long life time through the current transformer to separate the detects of the AC strong electric and DC weal electric. The current/voltage conversion circuit gets the analog drive state signal of the switch with strong anti-jamming capability. Change the resistor of the detect resistor, it can be applicable in different work current range of drive circuit. It's suitable for mass production.

A lamp controller with extended life of the present invention failure diagnoses and proceeds the two same drive circuits in the same time through the microcontroller and the coupled switch circuit and the drive state detect circuit. When one drive circuit is normal in work state and supplies power to the light source, the other one is situated in backup state. If the drive circuit in work state is broken down, the microcontroller switches the drive circuit broken to backup drive circuit through switch circuit in the light source power supply system. Then the light source will be powered by the backup drive circuit. As the average life of the drive circuit is 50000 hours, it can be determined that the life of the integral lamp with two drive circuits can reach to 100000 hours, which meets the life of the light source. With the lamp controller of the present invention, the life of the lamp is extended, which meets the green energy saving and environmental protection requirement. During usage, it's of maintenance free, greatly improving the technical and economic performance.

In detailed, the advantages of the present invention are as below:

1. Different lamp with different work power. The lamp controller with extended life of the present invention can work with failure identification and controlling of the drive circuit with larger power range. It's provided with high flexibility.

2. Different lamp with different light source and different drive circuit. For example, in LED, OLED, halogen lamp, as with different light source, the theory of the drive circuit is in different. The lamp controller with extended life of the present invention can ignore the types of specification of the light source but identifying and controlling the work state of the drive circuit. It's of wide applicability.

3. different lamp, such as the LED lamp, with different specification and array combination from different factory, the corresponding output parameter of the drive circuit is different, the output voltage and current are different. The lamp controller with extended life of the present invention includes a drive circuit of all kinds of output voltage and current. It's with maximum convenience.

4. the lamp must meet the certification requirement, especially the drive circuit. The lamp controller with extended life of the present invention allows user to choose different brand and certified drive circuit and to develop high reliability, long life and maintenance free lamp with lowest cost and shortest development cycle to meet different market needs.

5. The lamp controller with extended life of the present invention is maintenance free during the entire lamp usage process. Compared to other lamps of short life and high maintenance cost during usage, the lamp controller with extended life of the present invention provides the lamp with green energy saving and environmental protection, which is really of largest economy and superiority in the recent world.

DETAILED DESCRIPTION OF THE EMBODIMENT

Figure 1:
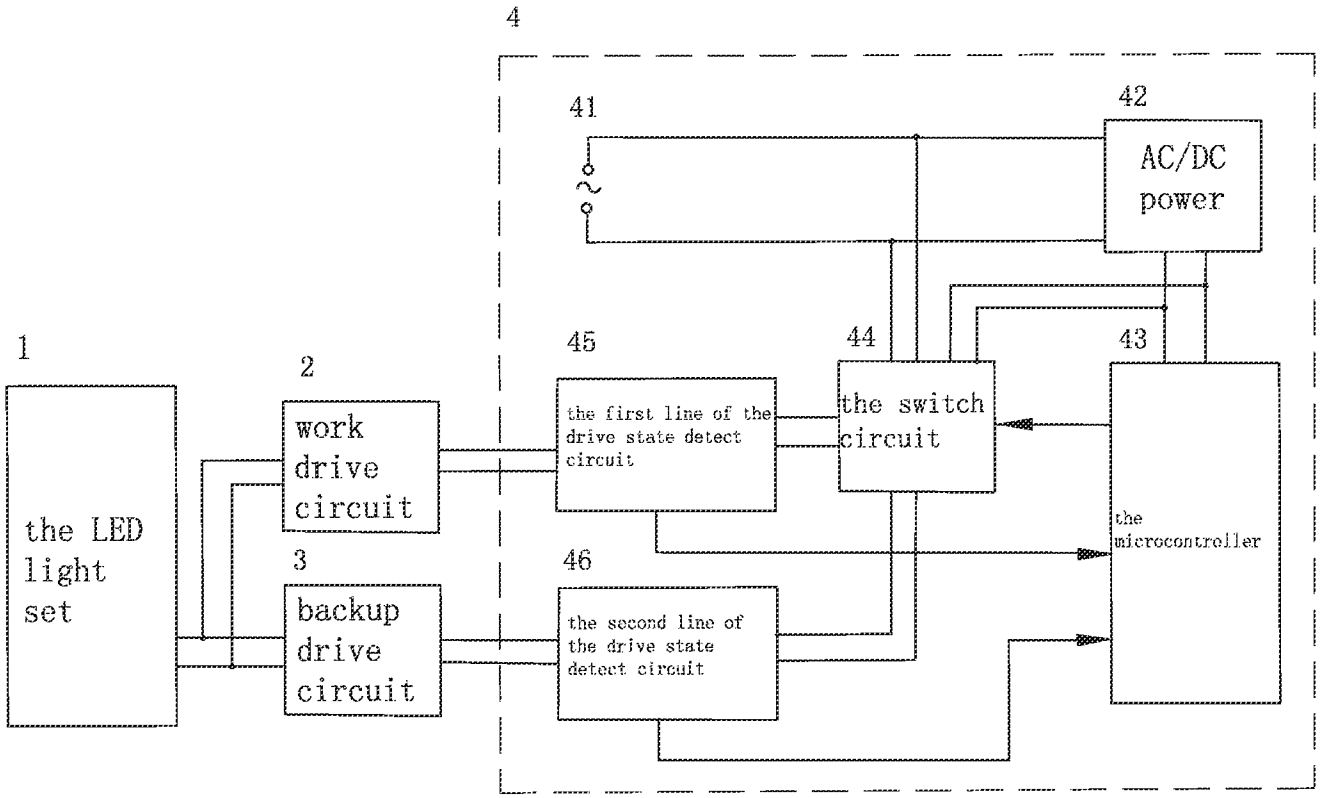
FIG. 1 illustrates the circuit of the lamp of the first embodiment of present invention.

As figured in the FIG. 1, the circuit diagram of the long life lamp of the first embodiment applied with a lamp controller with extended life of the present invention is provided. the lamp includes an LED light set 1 (the light source), two same drive circuits 2, 3 and a controller 4; one of the two drive circuits 2, 3 is a work drive circuit 2, the other is a backup drive circuit 3. the output of the two drive circuits 2, 3 are parallel and connected to the LED light set 1.

The controller 4 includes a mains supply connector 41, an AC/DC conversion circuit (the AC/DC power) 42, a microcontroller 43, a switch circuit 44 and two same drive state detect circuit 45, 46. the AC/DC conversion circuit 42 converts the mains supply from the mains supply connector 41 to low voltage DC to supply power to the microcontroller 43 and the switch circuit 44. the AC input of the switch circuit 44 is connected to the mains supply connector 41. the first AC output of the switch circuit 44 is connected to the AC input of the first line of the drive state detect circuit 45, the second AC output of the switch circuit 44 is connected to the AC input of the second line of the drive state detect circuit 46. the signal control input of the switch circuit 44 is connected to the signal control output of the microcontroller 43. The AC output of the first line of the drive state detect circuit 45 is connected to the input of the work drive circuit 2. the AC output of the second line of the drive state detect circuit 46 is connected to the input of the backup drive circuit 3.

In normal times, the input of the switch circuit 44 is connected to the first AC output rather than the second AC output. The work drive circuit 2 is powered through the first line of the drive state detect circuit 45 and the backup drive circuit 3 is cut off in backup state. The signal detect outputs of the first and second line of the drive state detect circuit 45, 46 are separately connected to the corresponding signal detect input of the microcontroller. When the drive circuit is in normal work, the current the mains supply to the drive circuit is within the rated operating current. The failure of the drive circuit is generally due to the failure of the part of the semiconductor or failure welding, leading to a functional failure of the drive circuit and no power transmission to the load. Even that the internal component of the drive circuit is short or breakdown, eventually leading to blown fuse. Or big fluctuation happens in the power grid, leading to failure of the internal component and blown fuse. These failure will lead to no current or small current in the power supply line of the drive circuit (similar to no load in the drive circuit). The first line of the drive state detect circuit 45 gets the work state information of the work drive circuit 2 to the microcontroller 43. If the work drive circuit 2 is normal, the microcontroller 43 controls the switch circuit 44 to connect the input of the work drive circuit to the mains supply. Otherwise, if the work drive circuit 2 is broken down, the microcontroller 43 controls the switch circuit 44 to connect the input of the backup drive circuit 3 to the mains supply.

As with the two same drive state detect circuit 45, 46, the control procedure of the microcontroller 43 can switch the backup drive circuit 3 to be a work drive circuit. Then the second line of drive state detect circuit 46 gets the work state information of the backup drive circuit 3. If the backup drive circuit 3 is normal, the microcontroller 43 controls the switch circuit 44 to maintain the input of the work drive circuit connect to the mains supply. Otherwise, if the backup drive circuit 3 is broken down, the microcontroller 43 controls the switch circuit 44 to connect the input of the backup drive circuit 3 to the mains supply.

The First Embodiment

Figure 2:
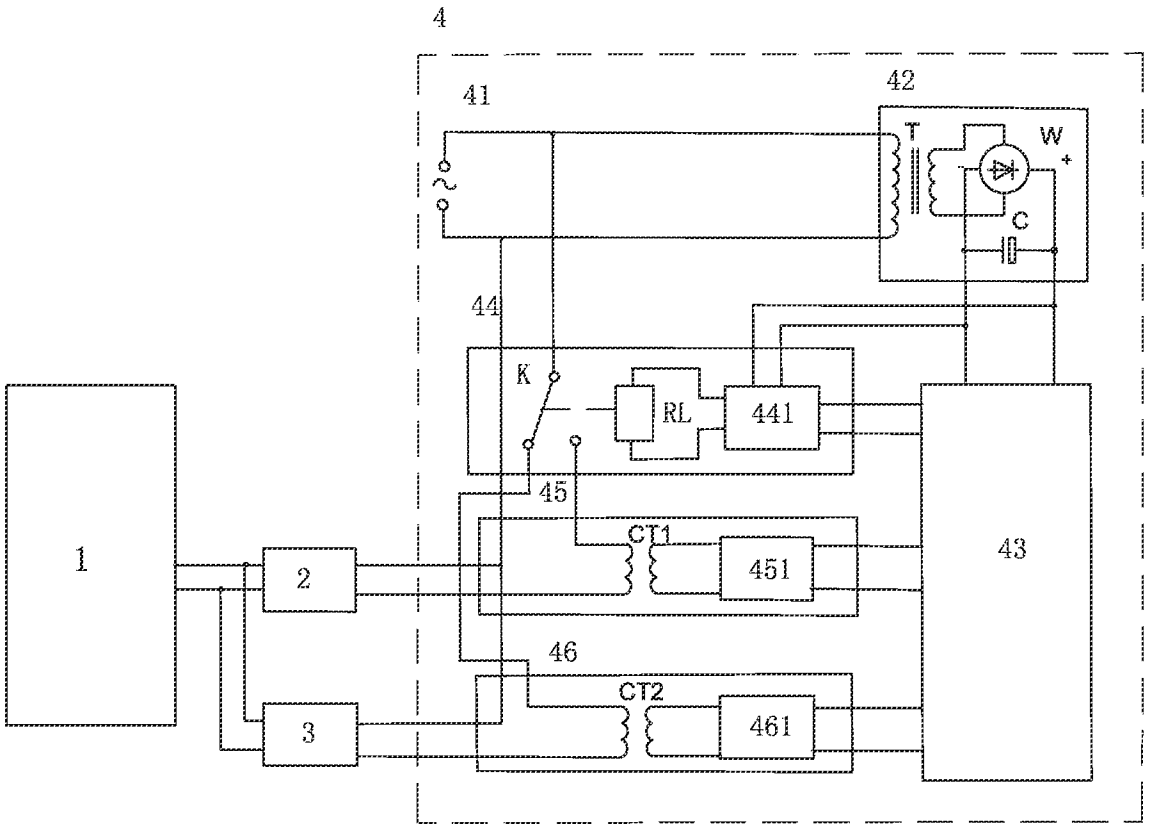
FIG. 2 illustrates the circuit of the first preferred embodiment of the first embodiment of the present invention.

As figured in the dotted line of the FIG. 2, the circuit diagram of first preferred embodiment of the first embodiment of a lamp controller with extended life of the present invention is provided. the controller 4 includes a mains supply connector 41, an AC/DC conversion circuit (the AC/DC power) 42, a microcontroller 43, a switch circuit 44 and two same drive state detect circuit 45, 46.

The AC/DC conversion circuit 42 is consisting of a frequency transformer T, a full-bridge rectifier W and a filtering capacitor C. it converts the main supply of the main supply connector 41 to low voltage AC to supply power to the microcontroller 43 and the switch circuit 44. The frequency transformer T has high reliability to supply power to the controller system. Other power supply system constituted of semiconductor elements like switch power or resistive and capacitive buck power is of low reliability due to the number of the semiconductor elements.

The switch circuit 44 is consisting of an electromagnet relay RL and a signal control amplifier 441. the signal control amplifier 441 is powered by the AC/DC conversion circuit 42. the earth line of the AC input of the switch circuit, the earth line of the first and second AC output, the earth line of the AC input of the first line of the drive state detect circuit 45, the earth line of the AC output of the first line of the drive state detect circuit 45, the earth line of the AC input of the second line of the drive state detect circuit 46, the earth line of the AC output of the second line of the drive state detect circuit 46 are connected to the earth line of the mains supply connector 41. The input of the alternative switch K of the electromagnet relay RL is for the connection of the live line of the AC input of the switch circuit 44 and the mains supply connector 41. the first output of the alternative switch K of the electromagnet relay RL is for the connection of live line of the first AC output of the switch circuit 44 and live line of the AC input of the first line of the drive state detect circuit 45. the second output of the alternative switch K of the electromagnet relay RL is for the connection of live line of the second AC output of the switch circuit 44 and live line of the AC input of the second line of the drive state detect circuit 46. The signal control input of the switch circuit 44 is connected to the signal control output of the microcontroller 43. The signal control amplifier 441 amplifies the signal of the microcontroller 43 and energizes the coil of the relay RL, making the alternative switch K of the relay RL alternatively connect the input to one of the two outputs.

The first drive state detect circuit 45 is consisting of a current transformer CT1 and a current/voltage conversion circuit 451. two ends of the primary side of the current transformer CT1 are separately the live line of the AC input and output of the first line of the drive state detect circuit 45; the primary side of the current transformer CT1 is series connected to the first output of the alternative switch K of the relay and the live line of the AC power input of the work drive circuit 2. the secondary side of the current transformer CT1 is connected to the input of the current/voltage conversion circuit 451; the output of the current/voltage conversion circuit 451 is the signal control output of the first line of the drive state detect circuit 45 to connect to the first signal detect input of the microcontroller 43. the current/voltage conversion circuit 451 can be a dividing circuit consisting of two resistors of series connection the two end points of the dividing circuit is the input of the current/voltage conversion circuit 451, the middle point and one of the end point of the dividing circuit is the output of the current/voltage conversion circuit 451.

The second drive state detect circuit 46 is consisting of a current transformer CT2 and a current/voltage conversion circuit 461. two ends of the primary side of the current transformer CT2 are separately the live line of the AC input and output of the second line of the drive state detect circuit 46; the primary side of the current transformer CT2 is series connected to the second output of the alternative switch K of the relay and the live line of the AC power input of the backup drive circuit 3. the secondary side of the current transformer CT2 is connected to the input of the current/voltage conversion circuit 461; the output of the current/voltage conversion circuit 461 is the signal control output of the second line of the drive state detect circuit 46 to connect to the second signal detect input of the microcontroller 43. the current/voltage conversion circuit 461 can be a dividing circuit consisting of two resistors of series connection, the two end points of the dividing circuit is the input of the current/voltage conversion circuit 461, the middle point and one of the end point of the dividing circuit are the output of the current/voltage conversion circuit 461.

In normal times, the input of the alternative switch K of the relay RL is connected to the first output. The work drive circuit 2 is powered and the backup drive circuit 3 is cut off in backup state. The current transformer CT1 of the first line of the drive state detect circuit 45 gets the work state information of the work drive circuit 2 to submit to the microcontroller 43 through the current/voltage circuit 451. If the work drive circuit 2 is in normal work, the current flows through the primary side of the current transformer CT1.The working current of the work drive circuit 2 is the current flowing through the primary side of the current transformer CT1, the faradic current of the secondary side of the current transformer CT1 is converted to effective voltage output by the current/voltage conversion circuit 451, and then submitted to the first signal detect input of the microcontroller 43. the current transformer CT1 is of high linearity, so the linearity of the voltage signal converted by the current/voltage conversion circuit 451 is proportional to the AC mains supply working current of the work drive circuit 2, so that the microcontroller 43 gets the current working current of the work drive circuit 2, if the work drive circuit 2 is in normal work, the microcontroller diagnoses that the work drive circuit 2 is normal, and keeps the relay RL in the current work state, the microcontroller 43 controls the switch circuit 44 keep the input of the alternative switch K of the relay RL connected to the first output and the input of the work drive circuit 2 connected to the mains supply, making the work drive circuit 2 keep in work state.

Otherwise, if the work state information of the work drive circuit 2 is failure, there is no current flowing through the primary side of the current transformer CT1, no faradic current is in second side of the current transformer CT1; the voltage output of the current/voltage conversion circuit 451 is zero, the microcontroller 43 get the failure information of the work drive circuit 2 from the first signal detect input. The microcontroller 43 controls the switch circuit 44 to make the input of the alternative switch K of the relay RL connected to the second output. The work drive circuit 2 is cut off. The input of the backup drive circuit 3 is connected to the mains supply and started to work.

The Second Embodiment

Figure 3:
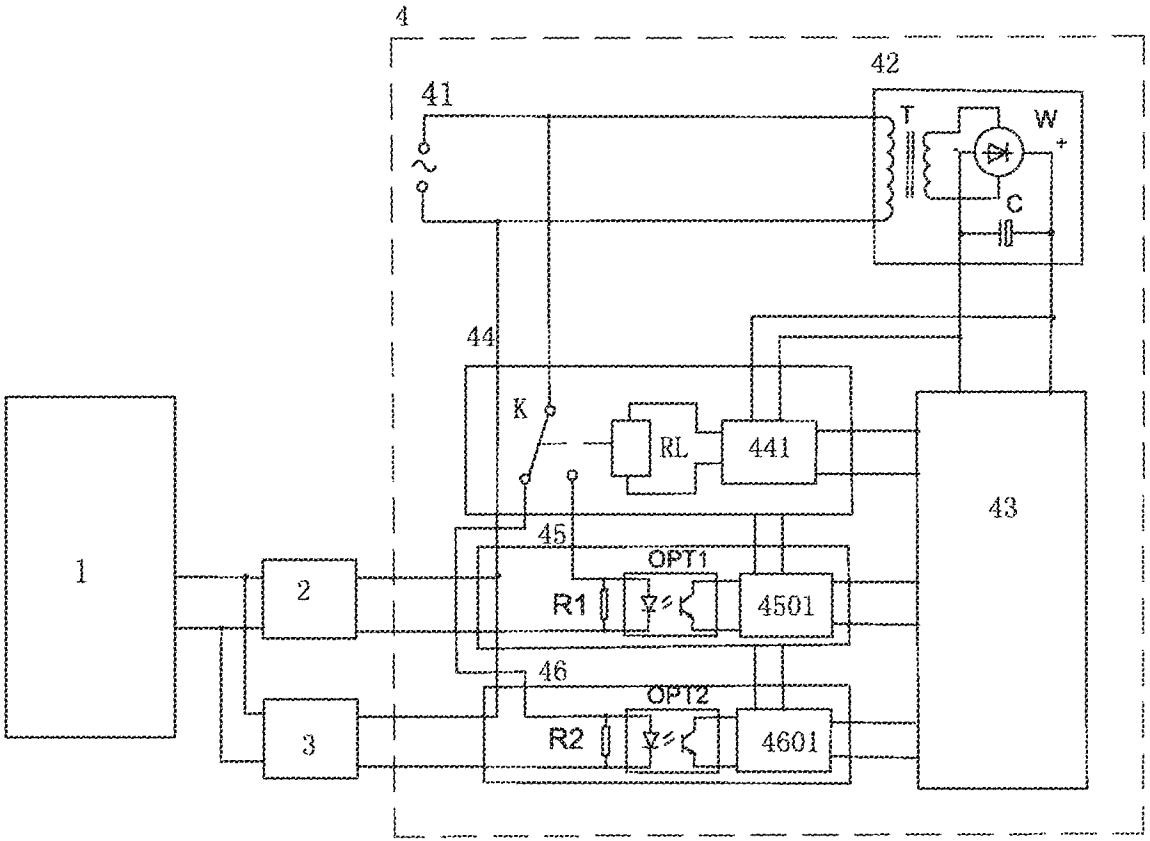
FIG. 3 illustrates the circuit of the second preferred embodiment of the first embodiment of the present invention.

As figured in the dotted line of the FIG. 3, the circuit diagram of first preferred embodiment of the second embodiment of a lamp controller with extended life of the present invention is provided. The controller 4 includes a mains supply connector 41, an AC/DC conversion circuit 42, a microcontroller 43, a switch circuit 44 and two same drive state detect circuit 45, 46.

The AC/DC conversion circuit 42 is consisting of a frequency transformer T, a full-bridge rectifier W and a filtering capacitor C it converts the main supply of the main supply connector 41 to low voltage AC to supply power to the microcontroller 43, the switch circuit 44 and the two drive state detect circuit 45, 46.

The switch circuit 44 is consisting of an electromagnet relay RL and a signal control amplifier 441, the signal control amplifier 441 is powered by the AC/DC conversion circuit 42, the earth line of the AC input of the switch circuit, the earth line of the first and second AC output, the earth line of the AC input of the first line of the drive state detect circuit 45, the earth line of the AC output of the first line of the drive state detect circuit 45, the earth line of the AC input of the second line of the drive state detect circuit 46, the earth line of the AC output of the second line of the drive state detect circuit 46 are connected to the earth line of the mains supply connector 41. The input of the alternative switch K of the electromagnet relay RL is for the connection of the live line of the AC input of the switch circuit 44 and the mains supply connector 41.

The first output of the alternative switch K of the electromagnet relay RL is for the connection of live line of the first AC output of the switch circuit 44 and live line of the AC input of the first line of the drive state detect circuit 45, the second output of the alternative switch K of the electromagnet relay RL is for the connection of live line of the second AC output of the switch circuit 44 and live line of the AC input of the second line of the drive state detect circuit 46. The signal control input of the switch circuit 44 is connected to the signal control output of the microcontroller 43. The signal control amplifier 441 amplifies the signal of the microcontroller 43 and energizes the coil of the relay RL, making the alternative switch K of the relay RL alternatively connect the input to one of the two outputs.

The first drive state detect circuit 45 is consisting of a detect resister R1, an optocoupler OPT1 and a current/voltage conversion circuit 4501. two ends of the detect resister R1 are separately the live line of the AC input and output of the first line of the drive state detect circuit 45; the detect resister R1 is series connected to the first output of the alternative switch K of the relay RL and the live line of the AC power input of the work drive circuit 2. detect resister R1 is parallel connected to light emitting diode of the optocoupler OPT1, the receiver of the optocoupler OPT1 is connected to the input of the current/voltage conversion circuit 4501; the output of the current/voltage conversion circuit 4501 is the signal control output of the first line of the drive state detect circuit 45 to connect to the first signal detect input of the microcontroller 43. the current/voltage conversion circuit 4501 can be a dividing circuit consisting of two resistors of series connection. The two end points of the dividing circuit is the input of the current/voltage conversion circuit 4501, the middle point and one of the end point of the dividing circuit are the output of the current/voltage conversion circuit 4501.

The second drive state detect circuit 46 is consisting of a detect resister R2, an optocoupler OPT2 and a current/voltage conversion circuit 4601. two ends of the detect resister R2 are separately the live line of the AC input and output of the second line of the drive state detect circuit 46; the detect resister R2 is series connected to the first output of the alternative switch K of the relay RL and the live line of the AC power input of the work drive circuit 2. the detect resister R2 is parallel connected to light emitting diode of the optocoupler OPT2, the receiver of the optocoupler OPT2 is connected to the input of the current/voltage conversion circuit 4601; the output of the current/voltage conversion circuit 4601 is the signal control output of the second line of the drive state detect circuit 46 to connect to the second signal detect input of the microcontroller 43. the current/voltage conversion circuit 4601 can be a dividing circuit consisting of two resistors of series connection. The two end points of the dividing circuit is the input of the current/voltage conversion circuit 4601, the middle point and one of the end point of the dividing circuit are the output of the current/voltage conversion circuit 4601.

In normal times, the input of the alternative switch K of the relay RL is connected to the first output. The work drive circuit 2 is powered and the backup drive circuit 3 is cut off in backup state. The detect resistor R1 of the first line of the drive state detect circuit 45 gets the work state information of the work drive circuit 2 to submit to the microcontroller 43 through optocoupler OPT1 and the current/voltage conversion circuit 451. If the work drive circuit 2 is in normal work, the current flows through the resistor R1. The AC mains supply working current of the work drive circuit 2 is the current flowing through detect resistor R1.

The voltage drop of the detect resistor R1 is coupled to the work voltage of the light emitting diode of the optocoupler OPT1, the light emitting diode of the optocoupler OPT1 lights, and the receiver of the optocoupler OPT1 induces the light signal, current flows through it, the current is converted to effective voltage output by the current/voltage conversion circuit 451, and then submitted to the first signal detect input of the microcontroller 43. so the microcontroller 43 gets the current working current of the work drive circuit 2. if the work drive circuit 2 is in normal work, the microcontroller diagnoses that the work drive circuit 2 is normal, and keeps the relay RL in the current work state, the microcontroller 43 controls the switch circuit 44 keep the input of the alternative switch K of the relay RL connected to the first output and the input of the work drive circuit 2 connected to the mains supply, making the work drive circuit 2 keep in work state.

Otherwise, if the work state information of the work drive circuit 2 is failure, there is no current flowing through the detect resistor R1. the light emitting diode of the optocoupler OPT1 doesn't lights. There is no faradic current of light signal in the optocoupler OPT1; the voltage output of the current/voltage conversion circuit 4501 is zero, the microcontroller 43 gets the failure information of the work drive circuit 2 from the first signal detect input. The microcontroller 43 controls the switch circuit 44 to make the input of the alternative switch K of the relay RL connected to the second output. The work drive circuit 2 is cut off The input of the backup drive circuit 3 is connected to the mains supply and started to work.

Figure 4:
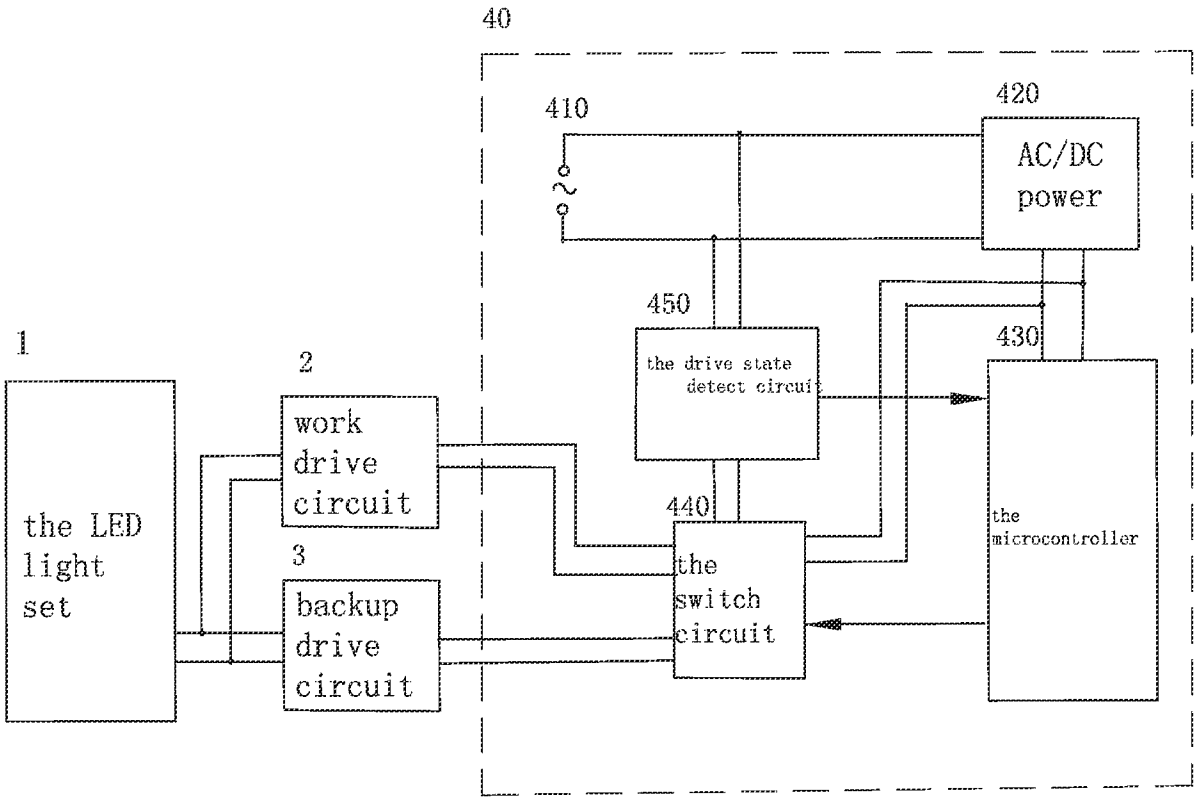
FIG. 4 illustrates the circuit of the lamp of the second embodiment of the present invention.

The circuit diagram of the second preferred embodiment of the long life lamp applied with the lamp controller with extended life of the present invention is figured in the FIG. 4. the lamp is disposed with an LED light set 1 (the light source), two same drive circuits 2, 3 and a controller 4; one of the two drive circuits 2, 3 is a work drive circuit 2, the other is a backup drive circuit 3. the output of the two drive circuits 2, 3 are parallel and connected to the LED light set 1.

The controller 4 includes a mains supply connector 410, an AC/DC conversion circuit (the AC/DC power) 420, a microcontroller 430, a switch circuit 440 and a drive state detect circuit 450. the AC/DC conversion circuit 420 converts the mains supply from the mains supply connector 410 to low voltage DC to supply power to the microcontroller 430 and the switch circuit 440. the AC input of the drive state detect circuit 450 is connected to the mains supply connector 410, the AC output of the drive state detect circuit 450 is connected to the AC input pf the switch circuit 440. the signal detect output of the drive state detect circuit 450 is connected to the signal detect input of the microcontroller 430. the first AC output of the switch circuit 440 is connected to the input of the work drive circuit 2, the second AC output of switch circuit 440 is connected to the input of the backup drive circuit 3.

In normal times, the input of the switch circuit 440 is connected to the first AC output rather than the second AC output. The work drive circuit 2 is powered through the first line of the drive state detect circuit 450 and the backup drive circuit 3 is cut off in backup state. The drive state detect circuit 450 gets the work state information of the work drive circuit 2 to the microcontroller 430. If the work drive circuit 2 is in normal work, the microcontroller 43 controls the switch circuit 440 to connect the input of the work drive circuit 2 to the mains supply of the drive state detect circuit 450. Otherwise, if the work drive circuit 2 is broken down, the microcontroller 430 controls the switch circuit 440 to connect the input of the backup drive circuit 3 to the mains supply of the drive state detect circuit 450.

Compared to the first embodiment, this embodiment is applied with a drive state detect circuit 450 to work with the microcontroller 430 to control and failure diagnosis of the two drive circuit 2, 3. it has better technical and economic performance.

The Third Embodiment

Figure 5:
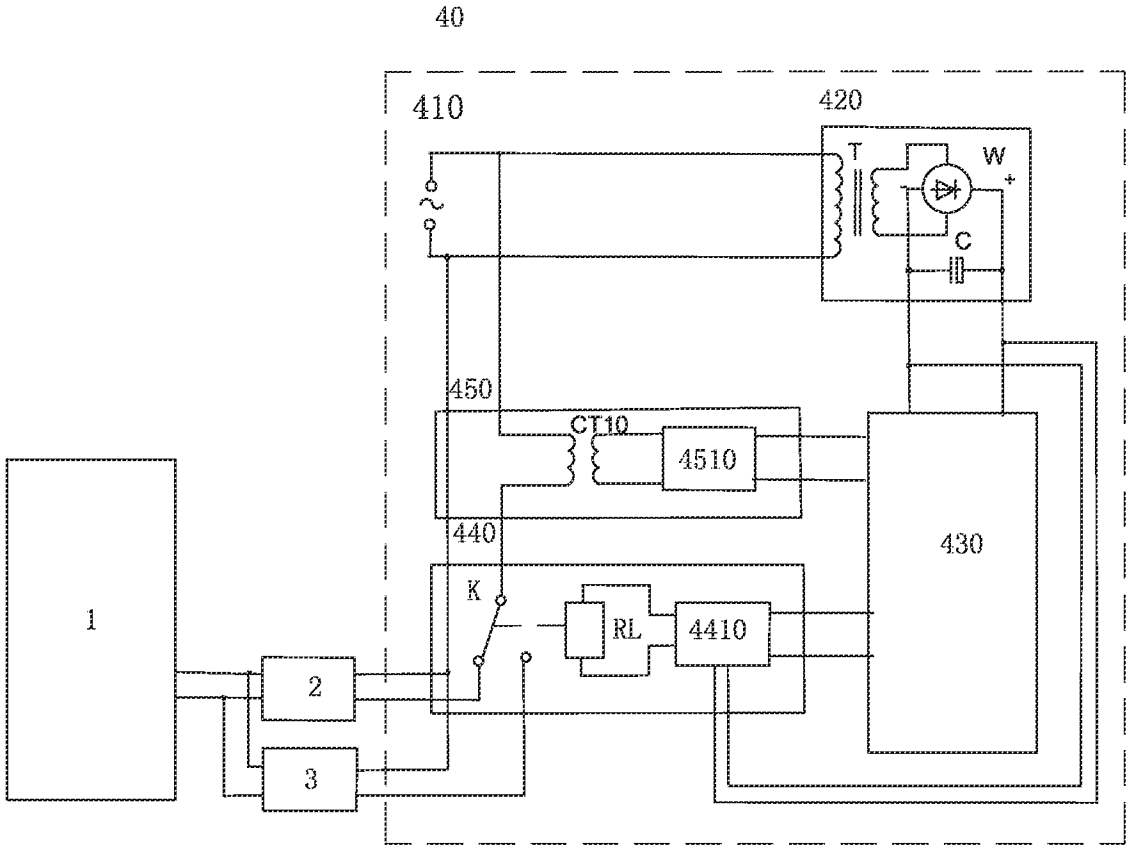
FIG. 5 illustrates the circuit of the first preferred embodiment of the second embodiment of the present invention.

The circuit diagram of the first preferred embodiment of the long life lamp applied with the lamp controller with extended life of the present invention is figured in the dotted line of the FIG. 5. this embodiment is simplified with the first embodiment and applied with an LED light set 1 of power within 100 W. The controller 40 includes a mains supply connector 410, an AC/DC conversion circuit 420, a microcontroller 430, a switch circuit 440 and a drive state detect circuit 450.

The AC/DC conversion circuit 420 is consisting of a frequency transformer T, a full-bridge rectifier W and a filtering capacitor C. it converts the main supply of the main supply connector 410 to low voltage AC to supply power to the microcontroller 430 and the switch circuit 440.

The drive state detect circuit 450 is consisting of a current transformer CT10 and a current/voltage conversion circuit 4510. the earth lines of the AC input and output of the drive state detect circuit 450 are connected to the mains supply connector 410. two ends of the primary side of the current transformer CT10 are separately connected to the live line of the AC output of the drive state detect circuit and the live line of the mains supply connector 410. the primary side of the current transformer CT10 is series connected to the live line of the mains supply connector 410 and the live line of the input of the switch circuit 440. the secondary side of the current transformer CT1 is connected to the input of the current/voltage conversion circuit 4510; the output of the current/voltage conversion circuit 4510 is the signal control output of the drive state detect circuit 450 to connect to the signal detect input of the microcontroller 430. The current/voltage conversion circuit 4510 can be a dividing circuit consisting of two resistors of series connection. the two end points of the dividing circuit is the input of the current/voltage conversion circuit 4510, the middle point and one of the end point of the dividing circuit is the output of the current/voltage conversion circuit 4510.

The switch circuit 440 is consisting of an electromagnet relay RL and a signal control amplifier 4410. the signal control amplifier 4410 is powered by the AC/DC conversion circuit 420. the earth line of the AC input of the switch circuit 440, the earth lines of the first and second AC outputs, the earth line of the AC input of the first line of the drive state detect circuit 450 are connected to the earth line of the AC output of the drive state detect circuit 450.

The input of the alternative switch K of the electromagnet relay RL is for the connection of live line of the AC output of the switch circuit 440 and AC output of the primary side of the current transformer CT10 in the drive state detect circuit 450. the first output of the alternative switch K of the electromagnet relay RL is for the connection of the live line of the first AC output of the switch circuit 440 and the live line of the AC input of the work drive circuit 2. the second output of the alternative switch K of the electromagnet relay RL is for the connection of live line of the second AC output of the switch circuit 440 and live line of the AC input of the backup drive circuit 3 The signal control input of the switch circuit 440 is connected to the signal control output of the microcontroller 430. The signal control amplifier 4410 amplifies the signal of the microcontroller 430 and energizes the coil of the relay RL, making the alternative switch K of the relay RL alternatively connect the input to one of the two outputs.

In normal times, the input of the switch circuit 440 is connected to the first output rather than the second output. The work drive circuit 2 is powered through the drive state detect circuit 450 and the backup drive circuit 3 is cut off in backup state. The current transformer CT10 of the first line of the drive state detect circuit 45 gets the work state information of the work drive circuit 2 to submit to the microcontroller 430 through the current/voltage circuit 4510. If the work drive circuit 2 is in normal work, the current flows through the primary side of the current transformer CT10. The working current of the work drive circuit 2 is the current flowing through the primary side of the current transformer CT10, the faradic current of the secondary side of the current transformer CT10 is converted to effective voltage output by the current/voltage conversion circuit 4510, and then submitted to the first signal detect input of the microcontroller 430. if the work drive circuit 2 is in normal work, the microcontroller 430 keeps the relay RL in the current work state, the microcontroller 430 controls the switch circuit 440 keep the input of the alternative switch K of the relay RL connected to the first output and the input of the work drive circuit 2 connected to the mains supply, making the work drive circuit 2 keep in work state.

Otherwise, if the work state information of the work drive circuit 2 is failure, there is no current flowing through the primary side of the current transformer CT10 of the drove state detect circuit 450. there is no faradic current in second side of the current transformer CT10; the voltage output of the current/voltage conversion circuit 4510 is zero, the microcontroller 430 gets the failure information of the work drive circuit 2 from the signal detect input. The microcontroller 430 controls the switch circuit 440 to make the input of the alternative switch K of the relay RL connected to the second output. The work drive circuit 2 is cut off. The input of the backup drive circuit 3 is connected to the mains supply and started to work through the drive state detect circuit 450.

The Fourth Embodiment

Figure 6:
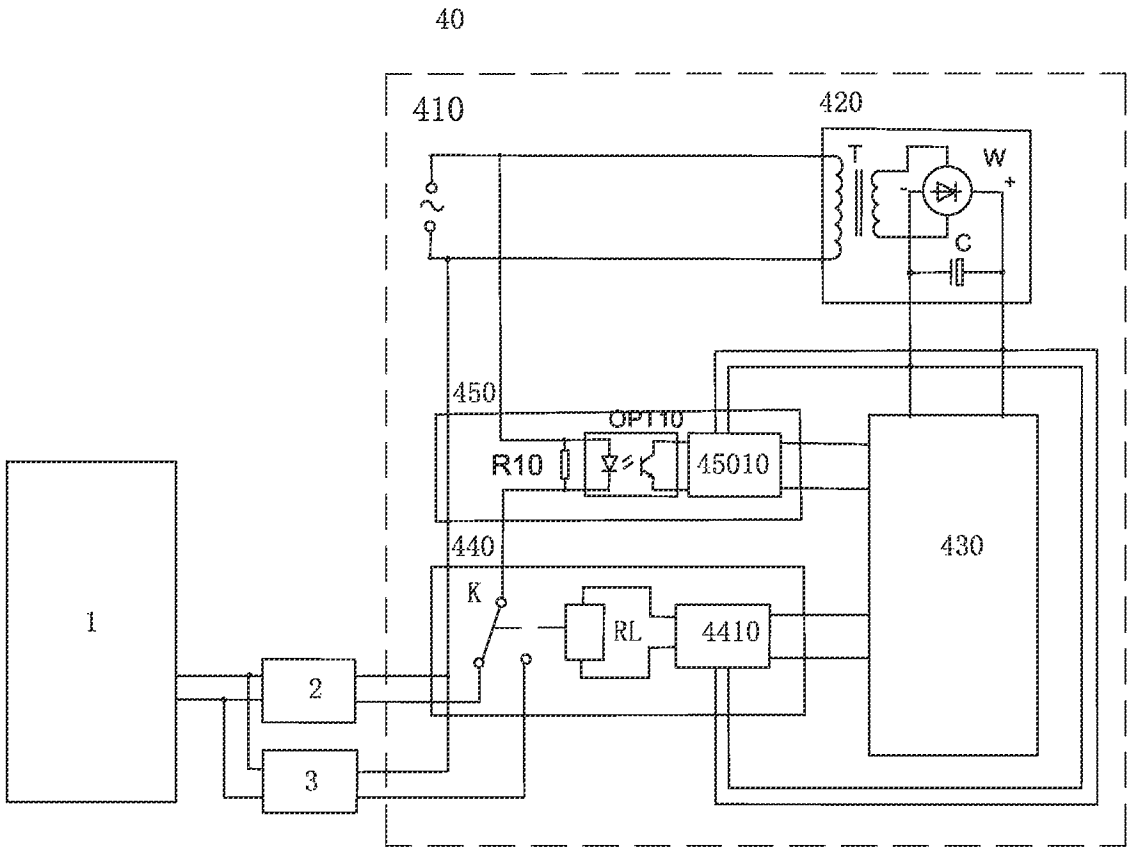
FIG. 6 illustrates the circuit of the second preferred embodiment of the second embodiment of the present invention.

The circuit diagram of the first preferred embodiment of the long life lamp applied with the lamp controller with extended life of the present invention is figured in the dotted line of the FIG. 6. This embodiment is simplified with the first embodiment and applied with an LED light set 1 of power within 100 W. The controller 40 includes a mains supply connector 410, an AC/DC conversion circuit 420, a microcontroller 430, a switch circuit 440 and a drive state detect circuit 450.

The AC/DC conversion circuit 420 is consisting of a frequency transformer T, a full-bridge rectifier W and a filtering capacitor C. it converts the main supply of the main supply connector 410 to low voltage AC to supply power to the microcontroller 430, the switch circuit 440 and the drive state detect circuit 450.

The drive state detect circuit 450 is consisting of a detect resister R10, an optocoupler OPT10 and a current/voltage conversion circuit 45010. the current/voltage circuit 45010 is powered by the AC/DC conversion circuit 420. two ends of the detect resister R10 are separately the AC input and output of the drive state detect circuit 450; the detect resister R10 is series connected to the live line of the mains supply connector 410 and the live line of the input of the switch circuit 440. the detect resistor R10 is parallel to the light emitting diode of the optocoupler OPT10, the receiver of the optocoupler OPT10 is connected to the input of the current/voltage conversion circuit 45010; the output of the current/voltage conversion circuit 45010 is the signal control output of the drive state detect circuit 450 to connect to the first signal detect input of the microcontroller 430. the current/voltage conversion circuit 45010 can be a dividing circuit consisting of two resistors of series connection. The two end points of the dividing circuit is the input of the current/voltage conversion circuit 45010, the middle point and one of the end point of the dividing circuit are the output of the current/voltage conversion circuit 45010.

The switch circuit 440 is consisting of an electromagnet relay RL and a signal control amplifier 4410. the signal control amplifier 4410 is powered by the AC/DC conversion circuit 420. the earth line of the AC input of the switch circuit 440, the earth lines of the first and second AC outputs, the earth line of the AC input of the first line of the drive state detect circuit 450, the earth line of the AC output of the drive state detect circuit 450 are connected to the earth line of the mains supply connector 410. The input of the alternative switch K of the electromagnet relay RL is for the connection of live line of the AC output of the switch circuit 440 and AC output of the primary side of the current transformer CT10 in the drive state detect circuit 450. the first output of the alternative switch K of the electromagnet relay RL is for the connection of the live line of the first AC output of the switch circuit 440 and the live line of the AC input of the work drive circuit 2. the second output of the alternative switch K of the electromagnet relay RL is for the connection of live line of the second AC output of the switch circuit 440 and live line of the AC input of the backup drive circuit 3 The signal control input of the switch circuit 440 is connected to the signal control output of the microcontroller 430. The signal control amplifier 4410 amplifies the signal of the microcontroller 430 and energizes the coil of the relay RL, making the alternative switch K of the relay RL alternatively connect the input to one of the two outputs.

In normal times, the input of the alternative switch K of the relay RL is connected to the first output. The work drive circuit 2 is powered and the backup drive circuit 3 is cut off in backup state. The detect resistor R10 of the first line of the drive state detect circuit 450 gets the work state information of the work drive circuit 2 to submit to the microcontroller 430 through optocoupler OPT10 and the current/voltage conversion circuit 45010. If the work drive circuit 2 is in normal work, the current flows through the resistor R10. The AC mains supply working current of the work drive circuit 2 is the current flowing through detect resistor R10. The voltage drop of the detect resistor R10 is coupled to the work voltage of the light emitting diode of the optocoupler OPT10, the light emitting diode of the optocoupler OPT10 lights, and the receiver of the optocoupler OPT10 induces the light signal, current flows through it, the current is converted to effective voltage output by the current/voltage conversion circuit 45010, and then submitted to the first signal detect input of the microcontroller 430. So the microcontroller 430 gets the current working current of the work drive circuit 2. if the work drive circuit 2 is in normal work, the microcontroller 430 keeps the relay RL in the current work state, the microcontroller 430 controls the switch circuit 440 keep the input of the alternative switch K of the relay RL connected to the first output and the input of the work drive circuit 2 connected to the mains supply, making the work drive circuit 2 keep in work state.

Otherwise, if the work state information of the work drive circuit 2 is failure, there is no current flowing through the detect resistor R10. the light emitting diode of the optocoupler OPT10 doesn't lights. There is no faradic current of light signal in the optocoupler OPT10; the voltage output of the current/voltage conversion circuit 45010 is zero, the microcontroller 430 gets the failure information of the work drive circuit 2 from the first signal detect input. The microcontroller 430 controls the switch circuit 440 to make the input of the alternative switch K of the relay RL connected to the second output. The work drive circuit 2 is cut off. The input of the backup drive circuit 3 is connected to the mains supply and started to work.

There are solid relay and electromagnet relay in the AC switch technology. The switch circuit in the above embodiments can be consisting of a solid relay and a signal control amplifier. The earth line of the AC input of the switch circuit is connected to that of the first AC output and the second AC output; the AC/DC conversion circuit supplies power to the signal control amplifier; the input terminal of the alternative switch of the solid relay is the live line of the AC input of the switch circuit, two output terminals of the alternative switch of the solid relay are separately the live line of the first and the second AC output of the switch circuit; the signal control amplifier amplifies the control signal of the microcontroller and motivates the coil of the solid relay, making the alternative switch of the solid relay alternatively connected the input terminal to one of the two output terminals.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A lamp controller with extended life wherein:

a lamp is disposed with a light source and two same drive circuits;

a first one of the drive circuits is a work drive circuit, and a second one of the drive circuits is a backup drive circuit;

outputs of the two drive circuits are parallel to each other and connected to the light source;

a controller includes an AC/DC conversion circuit, microcontroller, switch circuit and drive state detection circuit;

the AC/DC conversion circuit converts the mains supply to a low-voltage direct current and supplies power to the microcontroller and the switch circuit;

the drive state detection circuit gets work state information of the work drive circuit and submits the work state information to the microcontroller;

the microcontroller controls the switch circuit to alternatively connect the input of the work drive circuit or the backup drive circuit to the mains supply according to the work state information of the work drive circuit;

the drive state detection circuit is disposed with two same lines;

each line is disposed with an independent AC input, AC output and signal detect output;

the switch circuit is disposed with an AC input, a first AC output, a second AC output and signal control input;

the AC input of the switch circuit is connected to the mains supply;

the first AC output of the switch circuit is connected to the AC input of the first line of the drive state detection circuit;

the second AC output of the switch circuit is connected to the AC input of the second line of the drive state detection circuit;

the signal control input of the switch circuit is connected to the signal control output of the microcontroller;

the AC output of the first line of the drive state detection circuit is connected to the input of the work drive circuit;

the AC output of the second line of the drive state detection circuit is connected to the input of the backup drive circuit;

the signal detect outputs of the first line and second line of the drive state detection circuit are separately connected to the corresponding signal detect input of the two signal detect inputs of the microcontroller;

the switch circuit is consisting of an electromagnet relay and a signal control amplifier;

the earth line of the AC input of the switch circuit is connected to that of the first AC output and the second AC output;

the AC/DC conversion circuit supplies power to the signal control amplifier;

the input terminal of the alternative switch of the electromagnet relay is the live line of the AC input of the switch circuit, two output terminals of the alternative switch of the electromagnet relay are separately the live line of the first and the second AC output of the switch circuit;

the signal control amplifier amplifies the control signal of the microcontroller and motivates the coil of the electromagnet relay, making the alternative switch of the electromagnet relay alternatively connected the input terminal to one of the two output terminals.

2. A lamp controller with extended life wherein:

a lamp is disposed with a light source and two same drive circuits;

a first one of the drive circuits is a work drive circuit, and a second one of the drive circuits is a backup drive circuit;

outputs of the two drive circuits are parallel to each other and connected to the light source;

a controller includes an AC/DC conversion circuit, microcontroller, switch circuit and drive state detection circuit;

the AC/DC conversion circuit converts the mains supply to a low-voltage direct current and supplies power to the microcontroller and the switch circuit;

the drive state detection circuit gets work state information of the work drive circuit and submits the work state information to the microcontroller;

the microcontroller controls the switch circuit to alternatively connect the input of the work drive circuit or the backup drive circuit to the mains supply according to the work state information of the work drive circuit;

the drive state detection circuit is disposed with two same lines;

each line is disposed with an independent AC input, AC output and signal detect output;

the switch circuit is disposed with an AC input, a first AC output, a second AC output and signal control input;

the AC input of the switch circuit is connected to the mains supply, the first AC output of the switch circuit is connected to the AC input of the first line of the drive state detection circuit;

the second AC output of the switch circuit is connected to the AC input of the second line of the drive state detection circuit;

the signal control input of the switch circuit is connected to the signal control output of the microcontroller;

the AC output of the first line of the drive state detection circuit is connected to the input of the work drive circuit;

the AC output of the second line of the drive state detection circuit is connected to the input of the backup drive circuit;

the signal detect outputs of the first line and second line of the drive state detection circuit are separately connected to the corresponding signal detect input of the two signal detect inputs of the microcontroller;

the switch circuit is consisting of a solid relay and a signal control amplifier;

the earth line of the AC input of the switch circuit is connected to that of the first AC output and the second AC output;

the AC/DC conversion circuit supplies power to the signal control amplifier;

the input terminal of the alternative switch of the solid relay is the live line of the AC input of the switch circuit, two output terminals of the alternative switch of the solid relay are separately the live line of the first and the second AC output of the switch circuit;

the signal control amplifier amplifies the control signal of the microcontroller and motivates the coil of the solid relay, making the alternative switch of the solid relay alternatively connected the input terminal to one of the two output terminals.

3. A lamp controller with extended life wherein:

a lamp is disposed with a light source and two same drive circuits;

a first one of the drive circuits is a work drive circuit, and a second one of the drive circuits is a backup drive circuit;

outputs of the two drive circuits are parallel to each other and connected to the light source;

a controller includes an AC/DC conversion circuit, microcontroller, switch circuit and drive state detection circuit;

the AC/DC conversion circuit converts the mains supply to a low-voltage direct current and supplies power to the microcontroller and the switch circuit;

the drive state detection circuit gets work state information of the work drive circuit and submits the work state information to the microcontroller;

the microcontroller controls the switch circuit to alternatively connect the input of the work drive circuit or the backup drive circuit to the mains supply according to the work state information of the work drive circuit;

the drive state detection circuit is disposed with two same lines;

each line is disposed with an independent AC input, AC output and signal detect output;

the switch circuit is disposed with an AC input, a first AC output, a second AC output and signal control input;

the AC input of the switch circuit is connected to the mains supply;

the first AC output of the switch circuit is connected to the AC input of the first line of the drive state detection circuit;

the second AC output of the switch circuit is connected to the AC input of the second line of the drive state detection circuit;

the signal control input of the switch circuit is connected to the signal control output of the microcontroller;

the AC output of the first line of the drive state detection circuit is connected to the input of the work drive circuit;

the AC output of the second line of the drive state detection circuit is connected to the input of the backup drive circuit;

the signal detect outputs of the first line and second line of the drive state detection circuit are separately connected to the corresponding signal detect input of the two signal detect inputs of the microcontroller;

the drive state detection circuit is consisting of a current transformer and a current/voltage conversion circuit;

the two ends of the primary side of the current transformer are separately the AC input and AC output of the drive state detection circuit;

the secondary side of the current transformer is connected to the input of the current/voltage conversion circuit;

the output of the current/voltage conversion circuit is the signal detect output of the drive state detection circuit.

* * * * *